United States Patent [19]

Endtner et al.

[11] Patent Number: 4,750,843

[45] Date of Patent: Jun. 14, 1988

[54] APPARATUS FOR PRODUCING A STABLE EMULSION FOR USE IN CLEANING AND DECONTAMINATION DEVICES

[75] Inventors: Dieter Endtner, Waiblingen; Roland Schick, Auenwald; Helmut Stelzmüller, Neuhausen, all of Fed. Rep. of Germany

[73] Assignee: Alfred Karcher GmbH & Co., Winnenden, Fed. Rep. of Germany

[21] Appl. No.: 797,427

[22] Filed: Nov. 12, 1985

[30] Foreign Application Priority Data

Nov. 14, 1984 [DE] Fed. Rep. of Germany ..... 3441529

[51] Int. Cl.[4] ..... B01F 3/12; B01F 7/26; B01F 15/02

[52] U.S. Cl. ..... 366/177; 366/314; 366/315

[58] Field of Search ..... 366/134, 136, 167, 168, 366/171, 172, 174, 175, 177, 178, 314, 315, 181; 422/225, 231

[56] References Cited

U.S. PATENT DOCUMENTS

| | | | |
|---|---|---|---|
| 4,106,117 | 8/1978 | Cloots | 366/172 X |
| 4,389,376 | 6/1983 | Kojima et al. | 422/225 X |

FOREIGN PATENT DOCUMENTS

| | | | |
|---|---|---|---|
| 449893 | 7/1948 | Canada | 366/174 |
| 971250 | 12/1958 | Fed. Rep. of Germany | 366/167 |
| 1085851 | 7/1960 | Fed. Rep. of Germany | 366/134 |
| 1208737 | 1/1966 | Fed. Rep. of Germany | 366/177 |

*Primary Examiner*—Philip R. Coe

*Attorney, Agent, or Firm*—Wolf, Greenfield & Sacks

[57] ABSTRACT

In order to obtain a stable emulsion in a short time and in continuous operation of an apparatus for producing a stable emulsion for use in cleaning and decontamination devices, this apparatus containing solids suspended in water, a solvent and an emulsifier, it is suggested that a feed line for the solvent and the emulsifier which have a specific weight heavier than water be provided at the underside of a tank having a circular cross section, that a supply means for the solids suspended in water lead into the tank above the feed line, that means be provided for causing the contents of the tank to rotate about the longitudinal axis hereof and that the tank be surrounded by a collecting chamber receiving the emulsion overflowing over the upper edge of the tank, an outlet for the finished emulsion exiting from the collecting chamber.

19 Claims, 3 Drawing Sheets

Figure 1:
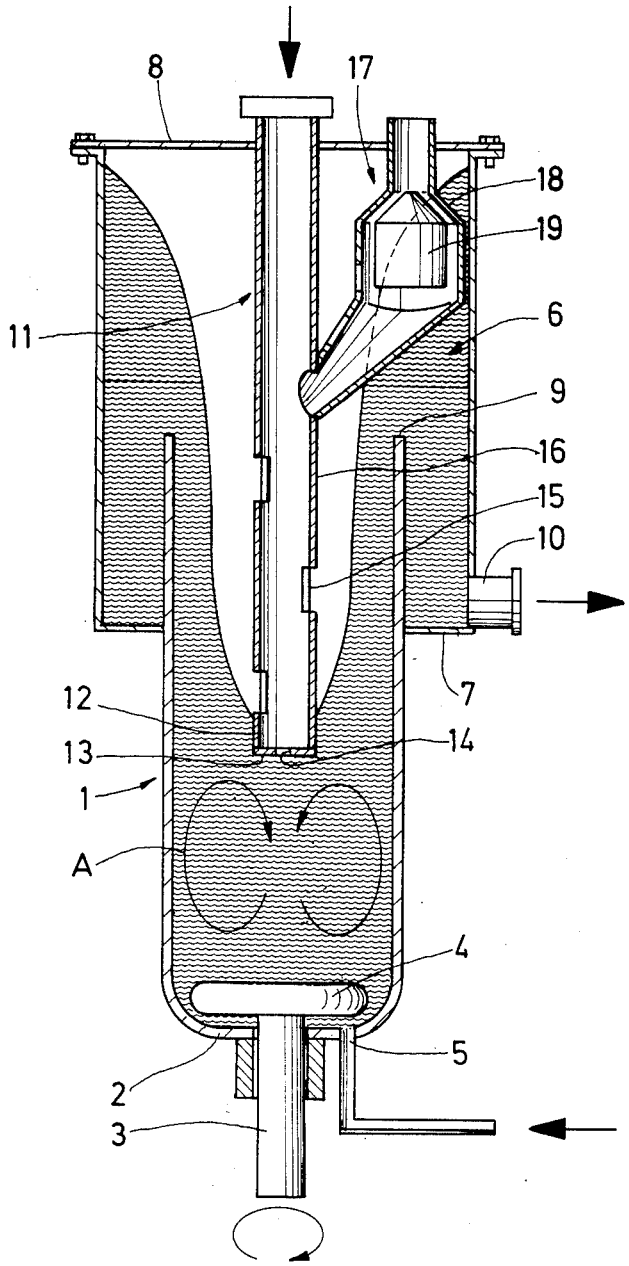

APPARATUS FOR PRODUCING A STABLE EMULSION FOR USE IN CLEANING AND DECONTAMINATION DEVICES

The invention relates to an apparatus for producing a stable emulsion for use in cleaning and decontamination devices, this apparatus containing solids suspended in water, a solvent and an emulsifier.

In the case of cleaning and decontamination devices it may be necessary, for certain operations, to continuously produce stable emulsions consisting of a plurality of liquid components and a powder or granulated solid matter so that emulsions continuously produced from these components may be added to a cleaning or decontamination jet issuing from the respective devices.

For this purpose, the components of the emulsion have previously been mixed in a batch in a complicated process and kept in motion during preparation. A mixing process of this type for producing the emulsion normally took about 30 minutes. A portion of the emulsion could be applied only after this relatively long time and no perfect blending of the individual components could be achieved. A further disadvantage of this method is the fact that the required amount cannot be exactly determined in advance and so problems occur with regard to removal or elimination of the remaining emulsion.

The object of the invention is to specify an apparatus of the type in question, with which a stable emulsion may be produced continuously and in a short time and also have a homogeneous composition.

This object is accomplished in accordance with the invention, for an apparatus of the type described at the outset, in that a feed line for the solvent and the emulsifier which have a specific weight heavier than water is provided at the underside of a tank or vessel having a circular cross section, that a supply means for the solids suspended in water leads into the tank above the feed line, that means are provided for causing the contents of the tank to rotate about the longitudinal axis of the tank and that the tank is surrounded by a collecting chamber receiving the emulsion overflowing over the upper edge of the tank, an outlet for the finished emulsion exiting from the collecting chamber.

In an apparatus of this type, the emulsion is formed in the tank by introducing the specifically lighter components (solids suspended in water) into the specifically heavier components (solvent and emulsifier) introduced into the tank from below. The liquid in the interior of the tank is caused to rotate so that the aqueous suspension of the solids is introduced downwardly into a moving liquid from above. In the area where mixing is most intensive the concentration of the aqueous suspension in the solvent and emulsifier is lower than in the finished emulsion. It is this area of most intensive mixing which promotes and accelerates the formation of emulsion. The emulsion formed in the tank overflows over the upper edge of the tank into a collecting chamber where it is quieted and stabilized and so the emulsion which finally leaves this collecting chamber is a stable emulsion. The apparatus operates continuously and produces the desired emulsion in a surprisingly short time.

In a first preferred embodiment, the means causing the contents of the tank to rotate is an agitating element rotatable about the longitudinal axis of the tank at the underside thereof. This may be designed as a flat disc and it is advantageous for the agitating element to be held on a drive shaft sealingly penetrating the underside of the tank.

It has proven particularly favourable for the feed line for the solvent and emulsifier to lead into the tank beneath the agitating element. This causes the solvent and the emulsifier to be intensively rotated in the lower region of the tank and the aqueous suspension is then introduced into this rotating liquid. Altogether, this encourages even mixing and a reliable formation of emulsion.

In a first preferred embodiment, the supply means for the solids suspended in water is formed by a pipe entering the tank concentrically from above, the pipe having outlet openings in its end face and at various levels in its casing. This pipe terminates preferably half way down the tank.

It is favourable for a vent line which is adapted to be closed by a float to branchoff the pipe so that the air entrained in the aqueous suspension may escape from the pipe and the tank.

In a modified embodiment, the supply means for the solids suspended in water is formed by supply lines opening into the tank in the side wall thereof, these supply lines preferably leading into the tank at differing levels. The supply lines may hereby lead radially into the tank but it is also possible, in a modified embodiment, for the supply lines to open tangentially into the tank and in the same direction of rotation. In this case, it may be possible to dispense with a driven agitating element if the force of the aqueous suspension introduced tangentially into the tank is such that the liquid in the tank is caused to rotate sufficiently by this force alone.

It is generally favourable for a vent line which is adapted to be closed by a float to be provided for.venting the tank.

The collecting chamber may overhang the tank at its upper side so that the liquid rising up the tank wall due to rotation can flow outwardly over the edge of the tank into the collecting chamber. The liquid surface which thereby results has a substantially parabolic cross section in the lower region whereas the liquid level in the upper region is much flatter since the rotation of the liquid in the tank is carried over into the collecting chamber only to a limited extent.

It is particularly favourable for the outlet to be located in the region of the underside of the collecting chamber since the emulsion in this region is particulary stable and quieted.

The bottom of the collecting chamber may be arranged between the bottom of the tank and a level approximately $\frac{2}{3}$ of the height of the tank.

In a first preferred embodiment, the tank is cylindrical in design. It is also, however, favourable for the side walls of the tank to be parabolic.

The outlet may be followed by a turbulence chamber which results in an additional homogeneous mixing of the emulsion.

Figure 2:
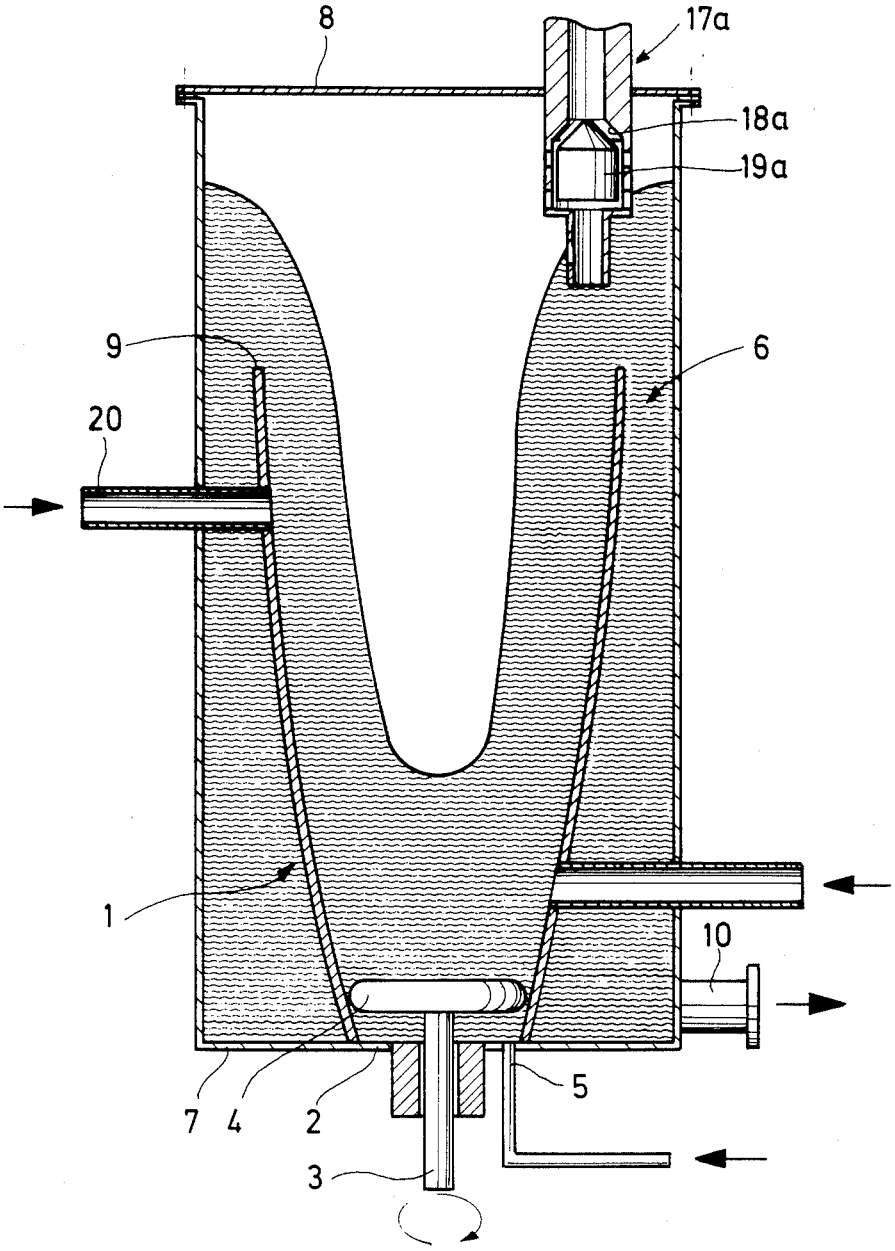
Figure 3:
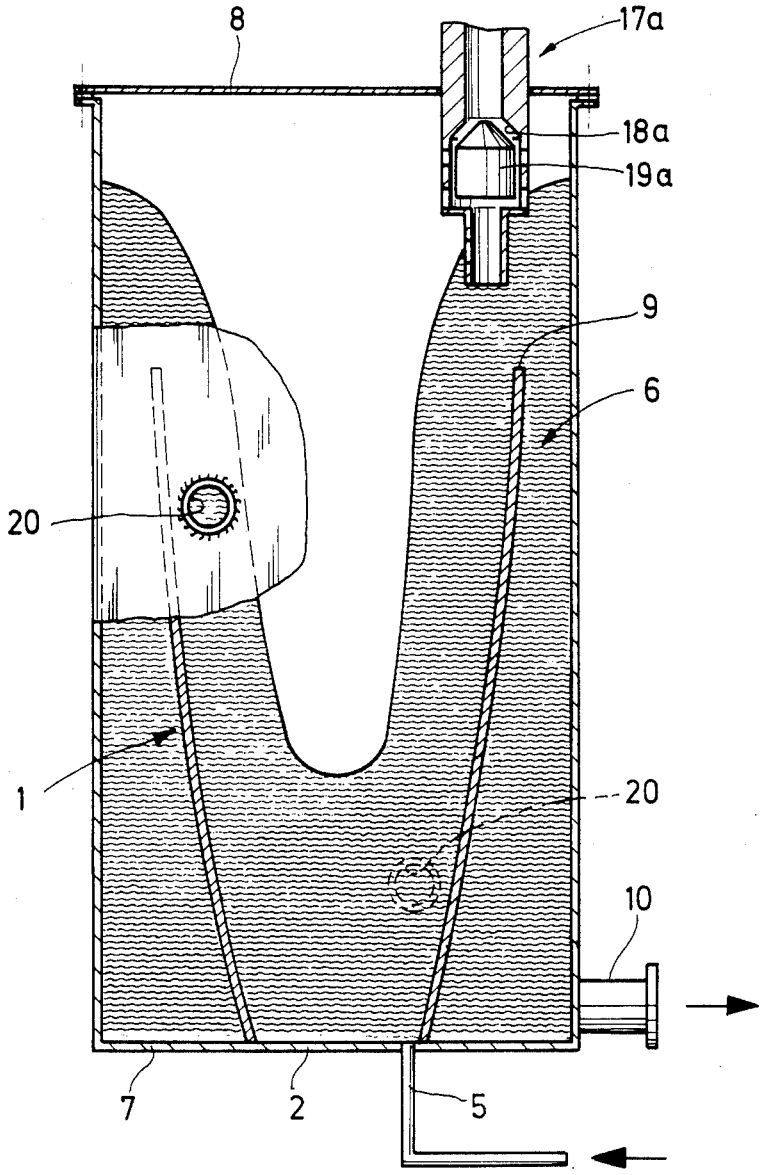

The following description of preferred embodiments of the invention serves to explain the invention in more detail in conjunction with the drawings, in which FIG. 1 is a cross-sectional view of an apparatus for producing an emulsion;

FIG. 2 is a view similar to FIG. 1 of a modified embodiment of an apparatus for producing an emulsion and FIG. 3 is a view similar to FIG. 1 of a further modified embodiment of an apparatus for producing an emulsion.

The emulsion produced in the apparatus which will be described in the following contains as components water, a solvent, e.g. chlorine-containing, aliphatic and aromatic hydrocarbons, an emulsifier acting as a phase transfer catalyst and a solid consisting of compounds containing active chlorine, i.e. compounds which, with water under hydrolysis, are capable of separating chlorine and hypochlorite, such as e.g. calcium hypochlorite, chloride of lime or alkali hypochlorite.

Emulsions of this type are used for cleaning and disinfecting and are sprayed for this purpose through a high-pressure spraying apparatus.

In order to form the emulsion, an aqueous suspension is first produced in the customary manner by mixing water and the powdery or granulated solids. This aqueous suspension is then mixed, in the apparatus to be described in the following, with a liquid chemical which contains a solvent and an emulsifier and is specifically heavier than water.

The first embodiment of an apparatus for producing emulsion, as illustrated in FIG. 1, comprises a circular-cylindrical tank 1 with a flat bottom 2 penetrated sealingly and concentrically by a drive shaft 3. This shaft bears a disc-shaped agitating element 4 on its end located in the interior of the tank. Beneath this agitating element 4 a feed line 5 leads through the bottom 2 into the interior of the tank 1. Its opening is below the disc-shaped agitating element 4. Solvent and emulsifier from a supply tank for solvent and emulsifier may be conveyed into the tank through this feed line, in a manner not illustrated, by means of a feed pump. The rate of flow may be regulated by a metering valve which is also not illustrated in the drawing.

The upper part of the tank 1 is surrounded by a collecting chamber 6 which is also circular-cylindrical. The external diameter of this collecting chamber is greater than that of the tank 1 and the bottom 7 of the collecting chamber is located approximately in the upper third of the tank 1. The collecting chamber 6 is closed by a cover 8. The closed upper side of the collecting chamber 6 projects a considerable distance beyond the upper edge 9 of the tank. For example, the upper edge 9 may end about half way up the collecting chamber 6.

The collecting chamber 6 has a radially exiting outlet 10 in the vicinity of its underside 7.

A pipe 11 leads into the collecting chamber 6 and the tank 1 through the cover 8 of the collecting chamber 6 and is concentric to the tank. The free end 12 of this pipe ends about half way down the tank 1. This pipe 11 has an outlet opening 14 in its end face 13 as well as additional outlet openings 15 in its side wall 16. The outlet openings 15 in the side wall are arranged at differing levels. None of the outlet openings 15 in the side wall are located above the upper edge 9 of the tank 1.

The aqueous suspension may be fed into the tank 1 through this pipe 11 from a suspension device which is not illustrated in the drawing.

A vent line 17 branches laterally off the pipe 11. This vent line leads upwardly through the cover 8 as well and has a conically tapering portion 18 in which a float 19 is located. This float has a conical upper side and closes the vent line 17, by interacting with the conical area 18, when the float rises up with the liquid. It does, however, release the vent line 17 when air is present in this vent line so that the air may escape to the outside.

During operation of the apparatus described the liquid in the interior of the tank and, to a lesser degree, in the interior of the collecting chamber as well is caused to rotate about the longitudinal axis of the tank by the agitating element 4. In this way, the surface of the liquid is substantially parabolic in the tank and becomes increasingly flatter in the collecting chamber. Solvent and emulsifier are supplied to the tank from below and the aqueous suspension from above through the pipe 11. A substantial portion of the aqueous suspension hereby enters the tank through the outlet opening 14 in the end face of the pipe and is fed directly to the region located above the agitating element 4, in which mixing is the most intensive, as indicated in FIG. 1 by arrows A. In this region, the concentration of the aqueous suspension is low which promotes the formation of emulsion. Once an emulsion has started to form in the region above the agitating element 4, this emulsion is driven upwards along the tank walls whilst additional aqueous suspension is fed to the emulsion through the lateral openings 15 in the pipe 11 and is emulsified. Once the emulsion has reached the upper edge of the tank 1 it has the desired composition; it is thoroughly and evenly mixed since the aqueous suspension is introduced from the stationary pipe into the emulsion rotating rapidly about the pipe.

The emulsion is quieted and stabilized in the collecting chamber above the upper edge 9 of the tank 1 and also in the annular chamber surrounding the upper side of the tank 1 above the bottom 7 of the collecting chamber 6. The emulsion is then passed through the outlet 10 and possibly through a turbulence chamber not illustrated in the drawings before being finally utilized. The emulsion is further stabilized in the turbulence chamber which may be equipped with baffle plates.

In this respect, it is important that the aqueous suspension, which takes up a greater voluminal proportion of the final emulsion, is gradually mixed in. The concentration of the suspension is therefore considerably lower at the commencement of emulsion formation than in the finished emulsion and this enables the emulsion to be formed in the desired manner. The concentration of the aqueous suspension in the emulsion is only gradually increased and to the extent in which the liquid in the tank travels upwards.

The embodiment illustrated in FIG. 2 is similarly constructed to that of FIG. 1 and the same parts therefore have the same reference numerals.

In this embodiment, the tank 1 is not circular-cylindrical in shape, the wall of the tank 1 being parabolic in design. The parabola is hereby cut off at its lower end by the flat bottom 2. The collecting chamber 6 completely surrounds the tank 1 and so the bottom 7 of the collecting chamber 6 is located in the same plane as the bottom 2 of the tank 1.

The aqeuous suspension is introduced not via a concentrically extending pipe but via a plurality of supply lines 20 penetrating radially through the collecting chamber 6 and opening in the wall of the tank 1. These supply lines are arranged at varying heights. As in the embodiment of FIG. 1, the aqueous suspension is first fed, via low-lying supply lines, to the area above the agitating element 4 where the concentration of the aqueous suspension is considerably lower than in the finished emulsion. As the emulsion rises through the interior of the tank 1, additional aqueous suspension is supplied through the supply lines 20 located at higher levels until the end concentration is finally reached.

A vent line 17*a* is also provided for this embodiment. In this case, the vent line does not branchoff the supply line for the aqueous suspension but is held on the cover 8. As in the embodiment of FIG. 1, the vent line has a conically tapering portion 18*a* and encloses a float 19*a* which closes the vent line in the area of its conically tapering portion.

The embodiment of FIG. 3 is similarly constructed to that of FIG. 2 and corresponding parts have the same reference numerals.

In this embodiment, the supply lines 20 do not lead radially into the tank 1 but tangentially and in a uniform direction of rotation so that the liquid in the interior of the tank is caused to rotate by introduction of the aqueous suspension. It is thereby possible to dispense with an agitating element in the tank. Otherwise, the emulsion is formed in the same way as in the embodiment of FIG. 2.

In all the embodiments, the interiors of the tank and the collecting chamber are subjected to overpressure, i.e. the two components fed into the interior chamber are supplied under pressure.

What is claimed is:

1. Apparatus for producing a stable emulsion containing solids suspended in water, a solvent and an emulsifier, the solvent and emulsifier having a specific weight heavier than water, the apparatus comprising:

a tank having a generally circular cross section;

means for feeding the solvent and the emulsifier into the bottom of the tank;

means for feeding solids into said tank at a plurality of different levels, all of said levels being above the level at which the solvent and emulsifier are fed into the tank;

means for causing the contents of the tank to rotate in the tank about the tank's longitudinal axis;

a collecting chamber for receiving the emulsion overflowing said tank; and an outlet from said collecting chamber for the finished emulsion.

2. Apparatus as defined in claim 1 wherein the means causing the contents of the tank to rotate is an agitating element positioned at the bottom of the tank and rotatable about the longitudinal axis thereof.

3. Apparatus as defined in claim 2, wherein the agitating element is a flat disc.

4. Apparatus as defined in claim 2 wherein the agitating element is mounted on a drive shaft sealingly penetrating the underside of the tank.

5. Apparatus as defined in claim 2 wherein the means for feeding the solvent and the emulsifier leads into the tank beneath the agitating element.

6. Apparatus as defined in claims 2 or 5 wherein the means for feeding solids is formed by a pipe entering the tank concentrically from above, said pipe having outlet openings in its end face and at various levels in its casing.

7. Apparatus as defined in claim 6 wherein the pipe ends approximately half way down the tank.

8. Apparatus as defined in claim 6 including a vent line branching off the pipe and a float adapted to close the vent line.

9. Apparatus as defined in claim 1 or 5, wherein the means for feeding solids includes supply lines opening into the tank in the side wall thereof.

10. Apparatus as defined in claim 7 wherein the supply line lead radially into the tank.

11. Apparatus as defined in claim 9 wherein the supply lines lead into the tank at differing levels.

12. Apparatus as defined in claim 11 wherein the supply lines lead into the tank tangentially and in the same direction of rotation.

13. Apparatus as defined in claim 1 including a vent line for venting the tank and a float adapted to close the vent line.

14. Apparatus as defined in claim 1 wherein the collecting chamber overhangs the tank at its upper side.

15. Apparatus as defined in claim 1 wherein the outlet is located near the bottom of said collecting chamber (6).

16. Apparatus as defined in claim 15 wherein the bottom of the collecting chamber is located between the bottom of the tank and a level approximately $\frac{2}{3}$ of the height of the tank.

17. Apparatus as defined in claim 1 wherein the tank (1) is cylindrical.

18. Apparatus as defined in claim 1 wherein the side walls of the tank are parabolic.

19. Apparatus as defined in claim 1 wherein the outlet is followed by a turbulence chamber.

* * * * *